US007045963B2

(12) United States Patent
Chen et al.

(10) Patent No.: US 7,045,963 B2
(45) Date of Patent: May 16, 2006

(54) PLASMA DISPLAY PANEL

(75) Inventors: Po-Cheng Chen, Yonghe (TW); Jiun-Han Wu, Sanchong (TW); Chen-Kwang Pan, Luodong Township, Yilan County (TW)

(73) Assignee: AU Optronics Corp., Hsinchu (TW)

( * ) Notice: Subject to any disclaimer, the term of this patent is extended or adjusted under 35 U.S.C. 154(b) by 141 days.

(21) Appl. No.: 10/792,098

(22) Filed: Mar. 3, 2004

(65) Prior Publication Data

US 2005/0134175 A1 Jun. 23, 2005

(30) Foreign Application Priority Data

Dec. 23, 2003 (TW) ..... 92136514 A

(51) Int. Cl.
*H01J 17/49* (2006.01)

(52) U.S. Cl. ..... 313/582; 313/583; 313/584; 313/585; 313/586; 313/587; 345/37; 345/41; 345/60; 315/169.4

(58) Field of Classification Search ..... 313/582, 313/585, 583, 584, 586, 587; 349/146; 315/169.4; 345/37, 41, 60

See application file for complete search history.

(56) References Cited

U.S. PATENT DOCUMENTS

| | | | | |
|---|---|---|---|---|
| 4,642,619 | A * | 2/1987 | Togashi | 345/695 |
| 5,311,337 | A * | 5/1994 | McCartney, Jr. | 349/145 |
| 5,982,095 | A * | 11/1999 | Jin et al. | 313/582 |
| 2001/0040539 | A1* | 11/2001 | Hashimoto | 345/60 |
| 2002/0063532 | A1* | 5/2002 | Chen et al. | 315/169.3 |
| 2002/0063701 | A1* | 5/2002 | Sano et al. | 345/204 |
| 2002/0175623 | A1* | 11/2002 | Kim et al. | 313/585 |
| 2004/0113553 | A1* | 6/2004 | Yoon et al. | 313/582 |
| 2004/0169473 | A1* | 9/2004 | Yoon et al. | 313/582 |

FOREIGN PATENT DOCUMENTS

JP 2002304948 A * 10/2002

* cited by examiner

*Primary Examiner*—Ashok Patel
*Assistant Examiner*—Christopher M. Raabe
(74) *Attorney, Agent, or Firm*—Thomas, Kayden, Horstmeyer & Risley

(57) ABSTRACT

A plasma display panel. Front and rear plates are spaced by a rib structure that is disposed on the rear plate with Neon gas filled therebetween. The rib structure partitions off the rear plate into a plurality of first, second and third sub-pixels adjacent to each other, wherein both of the first and second sub-pixels are smaller than the third one. Red, green and blue phosphors are disposed in the first, second and third sub-pixels respectively, wherein adjacent first, second and third sub-pixels form a pixel.

13 Claims, 8 Drawing Sheets

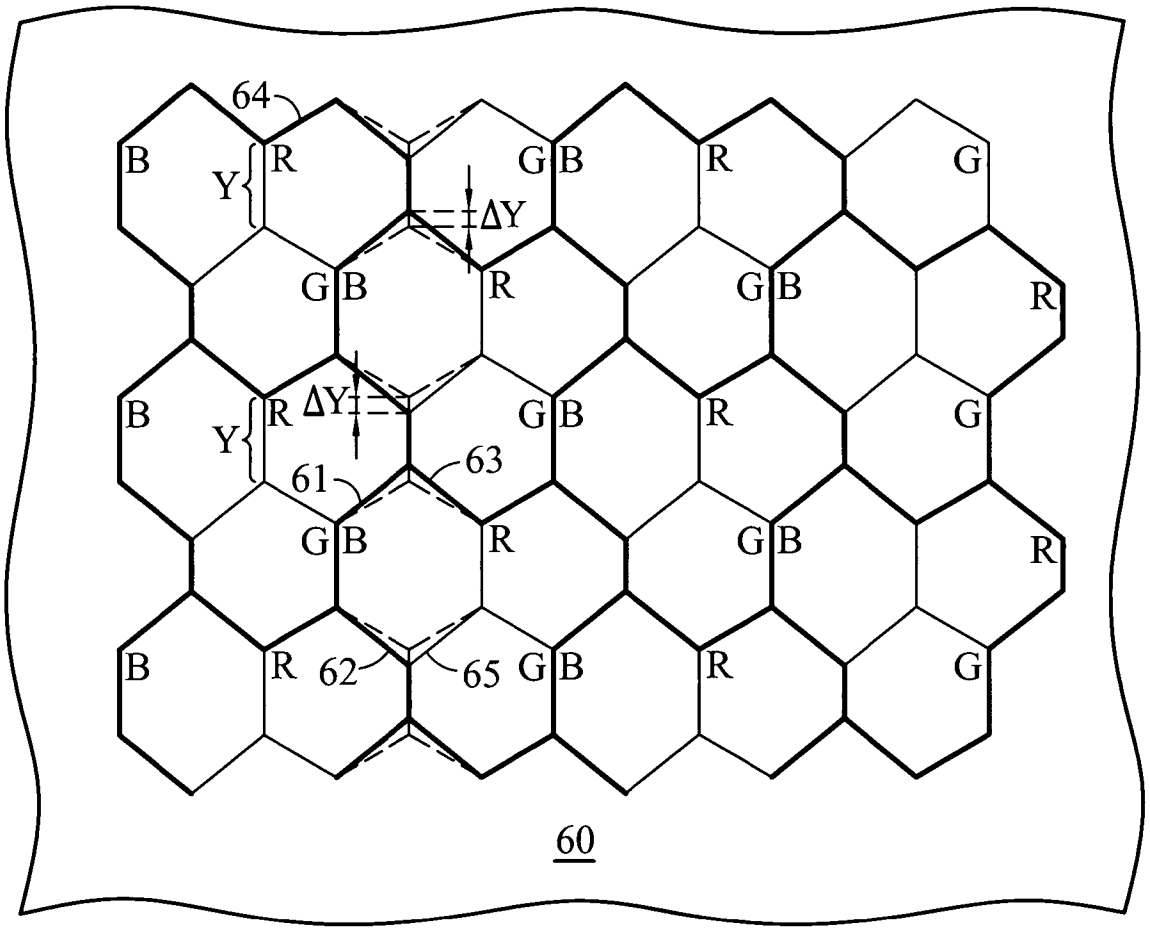
B
R
G
B
R
G
B
R
G

PLASMA DISPLAY PANEL

BACKGROUND OF THE INVENTION

1. Field of the Invention

The present invention relates to a plasma display panel for a display device, and in particular to a plasma display panel with improved color performance.

2. Description of the Related Art

Plasma display panels (hereinafter, "PDP") have found major implementation in color display devices, which are characterized as slim, lightweight, and large display area.

FIG. 1 is a cross-section of a conventional discharge cell on a PDP. A conventional PDP is composed of a front glass substrate 11 and a rear glass substrate 12, in opposition to each other, with barrier ribs 19 interposed in between. On the surface of the front glass substrate 11 facing the rear glass substrate 12, a plurality of sustain electrodes 13 and a plurality of scan electrodes 14 (only one pair shown) having a striped shape are alternately aligned parallel to each other. The sustain electrodes 13 and scan electrodes 14 are then coated with a dielectric layer 15 of lead glass or the like, and further coated with an MgO protective film 16, resulting in a front panel 100.

On the surface of the rear glass substrate 12 facing the front glass substrate 11, address electrodes 17 (only one shown) with a striped shape are aligned in parallel, and a dielectric layer 18 of lead glass or the like is formed on the rear glass substrate 12 to cover the plurality of address electrodes 17. The barrier ribs 19 are formed between neighboring address electrodes 17. Lastly, back phosphor layers 20R, 20G, and 20B in each of red (R), green (G), and blue (B) are applied to the gaps between neighboring barrier ribs 19 on the dielectric layer 18, resulting in a rear panel 200.

Discharge spaces 21 are formed between the front glass substrate 11 and the rear glass substrate 12 after assembly, where the plural pairs of electrodes 13 and 14 intersecting with the plural address electrodes 17 comprise cells, i.e. sub-pixels, for light emission. The discharge spaces 21 are filled with inert gas, neon (Ne), as a main component and a trace quantity of xenon as a buffer gas.

To produce an image display on this PDP, sustain discharge is induced between pairs of electrodes 13 and 14 in illuminated cells, to emit ultraviolet light. This ultraviolet light excites the phosphor layers 20R, 20G, and 20B, as a result of which visible light of the three primary colors red, green, and blue is generated and subjected to an additive process. Hence a full-color display is produced. Generally, the color performance of a PDP panel depends on the color purity and the brightness of the cells.

SUMMARY OF THE INVENTION

Neon (Ne) gas filling the discharge cells of a PDP shows orange color during discharge, thereby affecting color purity and color temperature of PDP pixels. The primary object of the invention is to adjust the chrominance of PDP pixels affected by the filled Neon gas.

To achieve the object, the present invention provides a plasma display panel (PDP) comprising a front substrate and a rear substrate opposite thereto, divided into discharge spaces therebetween by a rib structure disposed on the rear substrate. The rib structure divides the rear substrate into a plurality of first, second and third sub-pixels disposed next to each other sequentially. Red, green and blue phosphors are disposed on the first, second and third sub-pixels respectively, wherein a pixel is composed of adjacent first, second and third sub-pixels. The first sub-pixels coated with red phosphor and the second sub-pixels coated with green phosphor are smaller than the third sub-pixels coated with blue phosphor. The pixels between the front and rear substrates are filled with Neon gas.

In an embodiment, although the sizes of the first, second and third sub-pixels in the PDP are different, the corresponding address electrode of each pixel is still disposed in the center of each sub-pixel on the rear substrate.

In another embodiment, the first sub-pixels coated with red phosphor are smaller than the second sub-pixels coated with green phosphor, such that the size of the red sub-pixels<green sub-pixels<blue sub-pixels.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein:

FIG. 6 is another schematic top view of a PDP rear substrate with a pattern of sub-pixels and address electrodes thereon according to the invention.

DETAILED DESCRIPTION OF THE INVENTION

Generally, red, green and blue phosphors used in such a PDP are pre-filled into sub-pixels divided by a rib structure respectively before assembling. After assembling, discharge spaces of a PDP are divided between a front glass substrate and a rear glass substrate by the rib structure. After sealing the front and rear glass substrate, the discharge spaces, i.e. sub-pixels, are filled with an inert gas, neon (Ne), as a main component. However, according to the invention, it is found that Neon (Ne) gas filling the sub-pixels of a PDP shows orange color during discharge. The orange color of Neon gas enhances red and green colors of the displaying image than blue color because orange is the addition of red and green colors. Thus, embodiments hereinafter disclose how to adjust the color performance of a PDP according to the invention.

Figure 1:
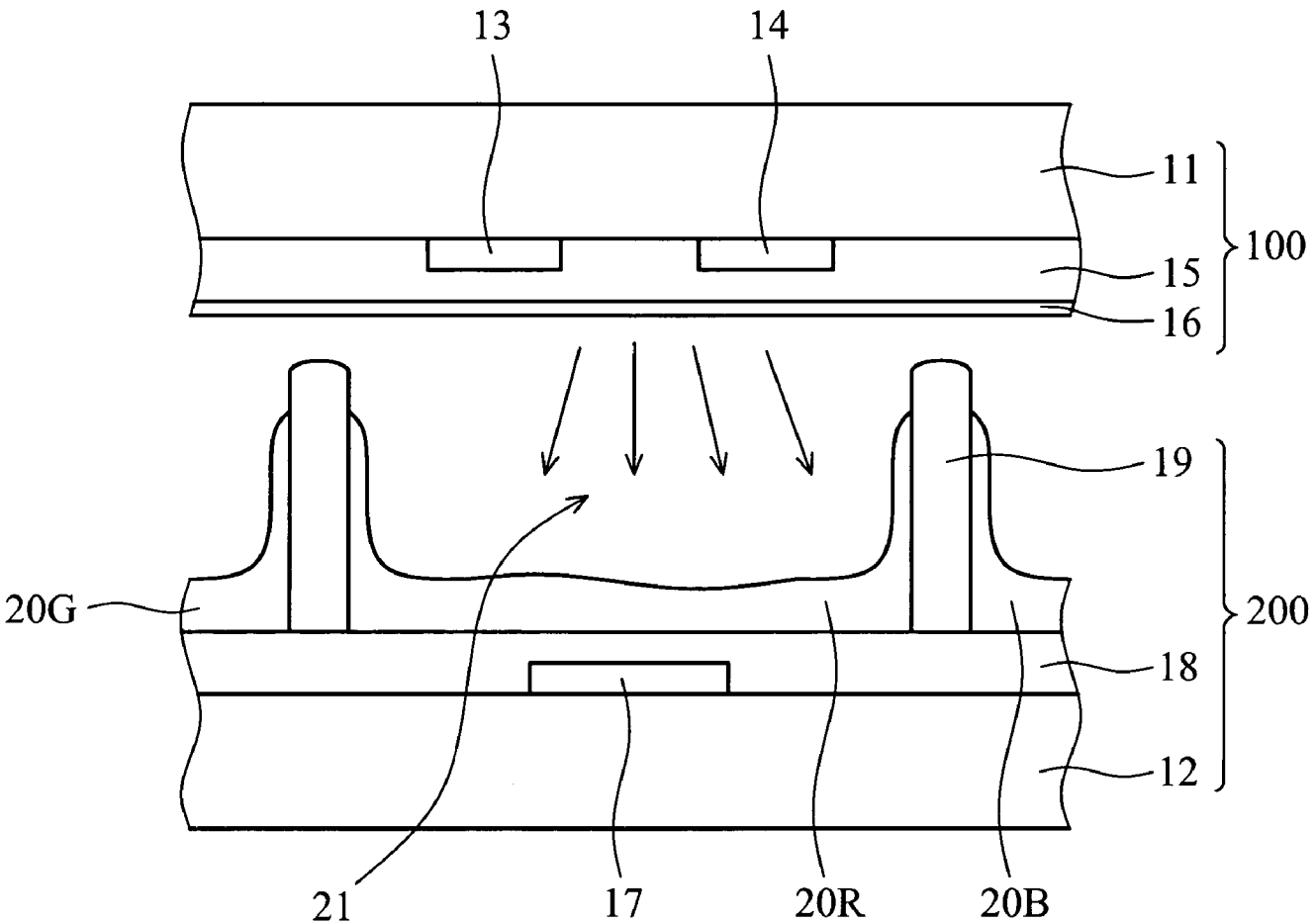
FIG. 1 (RELATED ART)
FIG. 1 is a cross-section of a conventional PDP cell.
Figure 2:
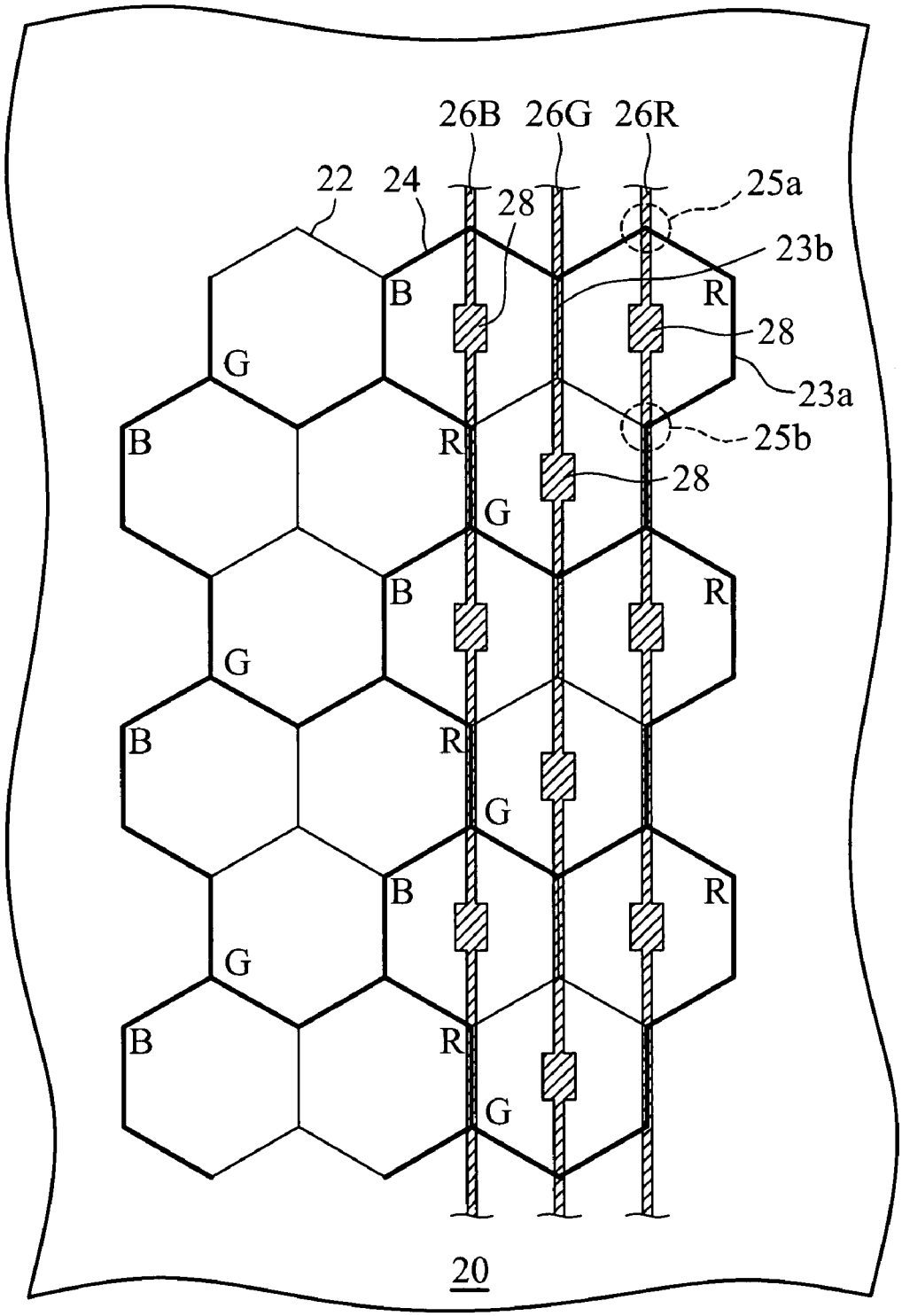
FIG. 2 is a top view of a conventional PDP rear substrate having honeycombed sub-pixels and address electrodes thereon.

The embodiments hereinafter are exemplified based on the modifications of honeycombed sub-pixels as shown in FIG. 2. However, the invention is not limited to the honeycombed sub-pixels disclosed. Accordingly, various shapes of sub-pixels can be made without departing from the spirit or scope of the general inventive concept as defined by the appended claims and their equivalent.

FIG. 2 is a top view of a conventional PDP rear substrate with honeycomb-type sub-pixels and address electrodes thereon. A rib structure 22 of honeycombed equilateral hexagons is formed on a rear substrate 20 by conventional sandblasting. Each equilateral hexagon is a sub-pixel, and all are adjacent to one another as shown in FIG. 2. Red, green and blue phosphors are disposed into the sub-pixels alternatively to form red sub-pixels (R), green sub-pixels (G) and blue sub-pixels (B) adjacent to one another. Adjacent red (R), green (G) and blue (B) sub-pixels comprise a dodecagonal pixel 24 (marked with bold lines in FIG. 2). Moreover, address electrode lines 26R, 26G and 26B are disposed on the rear substrate 20, passing through each string of red (R), green (G) and blue (B) sub-pixels respectively. Each address electrode line is disposed to pass though a pair of opposite angles 25*a* and 25*b* and parallel to a pair of opposite sides 23*a* and 23*b* of a honeycombed sub-pixel as shown in FIG. 2. Conventionally, address electrode blocks 28 are disposed on address electrode lines and in the center of the honeycombed sub-pixels to control them respectively.

First Embodiment

Figure 3A:
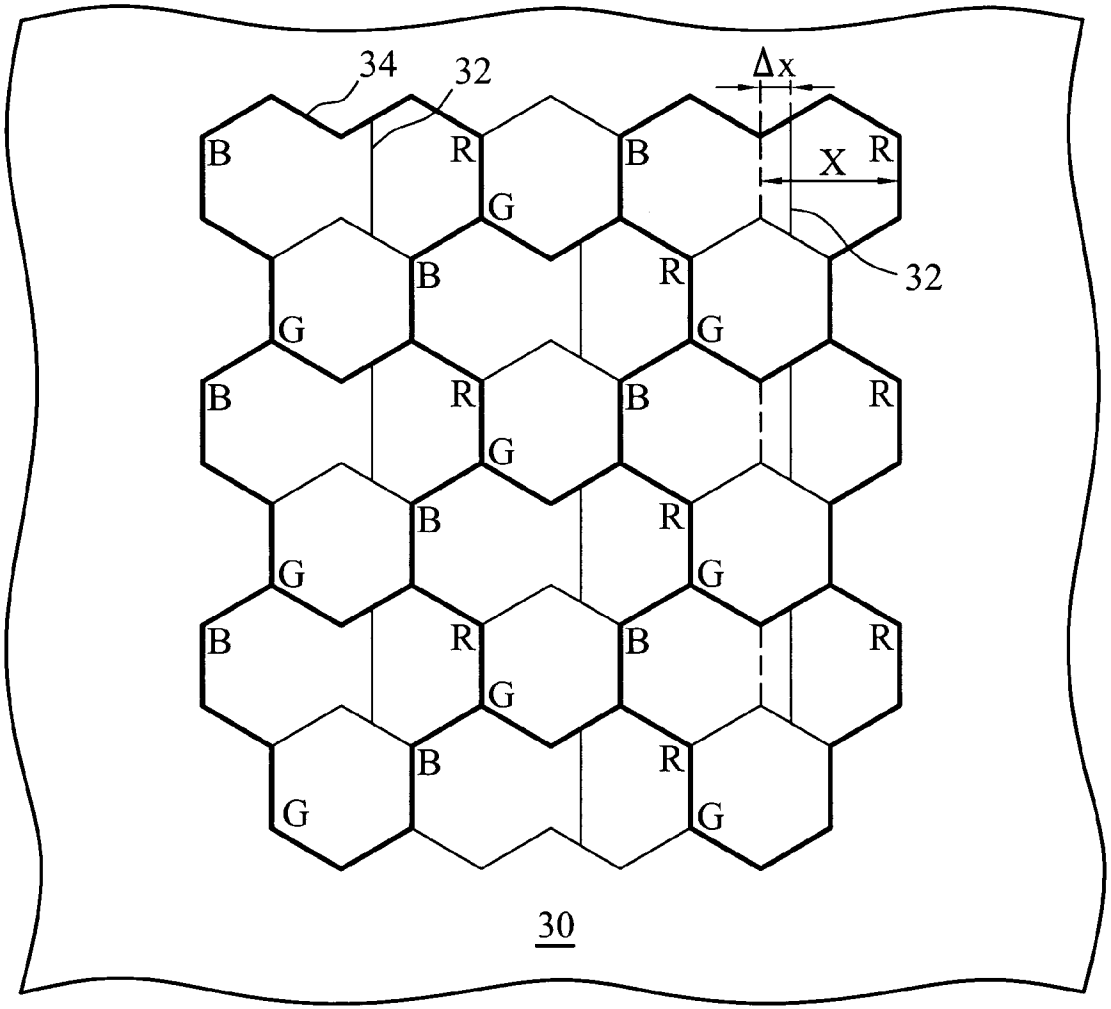
FIGS. 3A to 3E are schematic top views of PDP rear substrates with various patterns of sub-pixel and address electrodes thereon according to the invention.

Based on FIG. 2, FIGS. 3A to 3E are schematic top views of PDP rear substrates with patterns of sub-pixels and address electrodes thereon, according to a first embodiment of the invention. As shown in FIG. 3A, pixel 34 (i.e. marked with bold lines) on the rear substrate 30 comprises a unit of three adjacent honeycombed sub-pixels as in FIG. 2. The honeycombed green sub-pixels (G) support a width between every pair of opposite parallel sides of X. However, the adjacent side 32 between every red and blue sub-pixel (R and B) is shifted toward red sub-pixel (R) for Δx and the outline of the honeycombed sub-pixels R and B remains. Thus, the blue sub-pixels (B) are octagonal with an extension of Δx toward red sub-pixels (R), and red sub-pixels (R) are still hexagonal with a decrease of Δx. The dotted lines between sub-pixels in FIG. 3A show where the ribs of FIG. 2 were. As shown in FIG. 3A, after the adjustment, sizes of red sub-pixels (R)<green sub-pixels (G)<blue sub-pixels (B). However, the outline and size of a pixel 34 composed of a red, green and blue sub-pixel (R, G and B) in FIG. 3A still conforms to and equals that in FIG. 2.

Figure 3B:
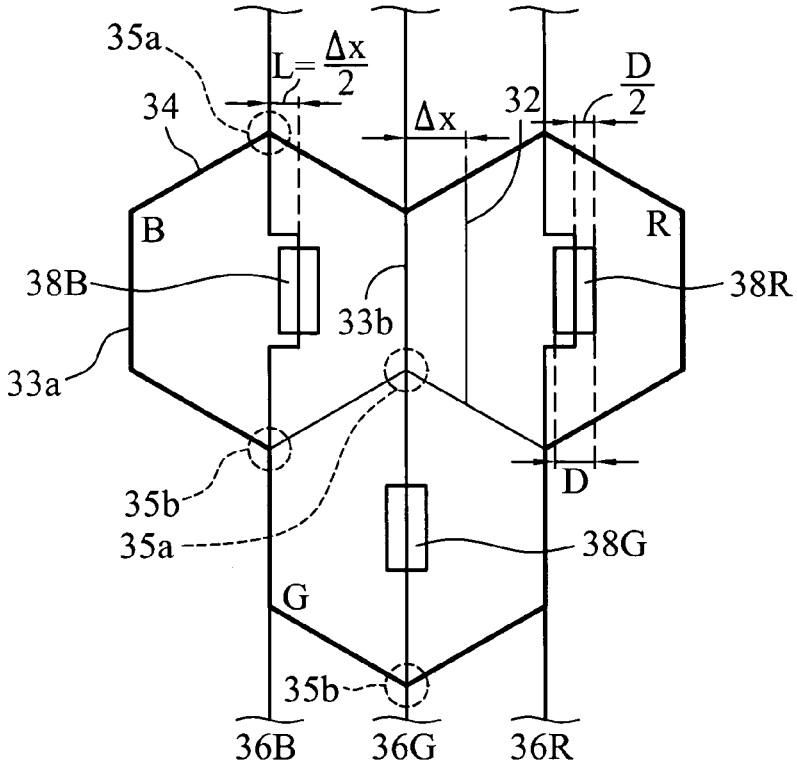

Address electrode lines or blocks can also be adjusted for better control of the sub-pixels shown in FIG. 3A. Generally, the address electrode blocks are disposed in the center of sub-pixels for better discharge efficiency. FIG. 3B shows an address electrode pattern of FIG. 3A according to the invention. The address electrode lines 36R, 36B and 36G still pass through opposite angles 35*a* and 35*b* of red, blue and green sub-pixels respectively. The address electrode lines 36G pass through the diagonal line of opposite angles 35*a* and 35*b* of green sub-pixels, identical to those in FIG. 2. However, the address electrode lines 36R and 36B parallely recess L=Δx/2 in the shifting direction of the adjacent side 32. The address electrode blocks 38R and 38B are disposed on the center of the recessed address electrode lines 36R and 36B, and the address electrode blocks 38G are disposed on the center of the straight address electrode lines 36G inside sub-pixels G. In FIG. 3, all address electrode lines 36R, 36B and 36G pass through the central axis, i.e. D/2, of the address electrode blocks 38R, 38B and 38G with width D, respectively. The pattern of address electrodes shown in FIG. 3B is applicable when the width D of address electrode blocks is less than the rib shift ΔX.

Figure 3C:
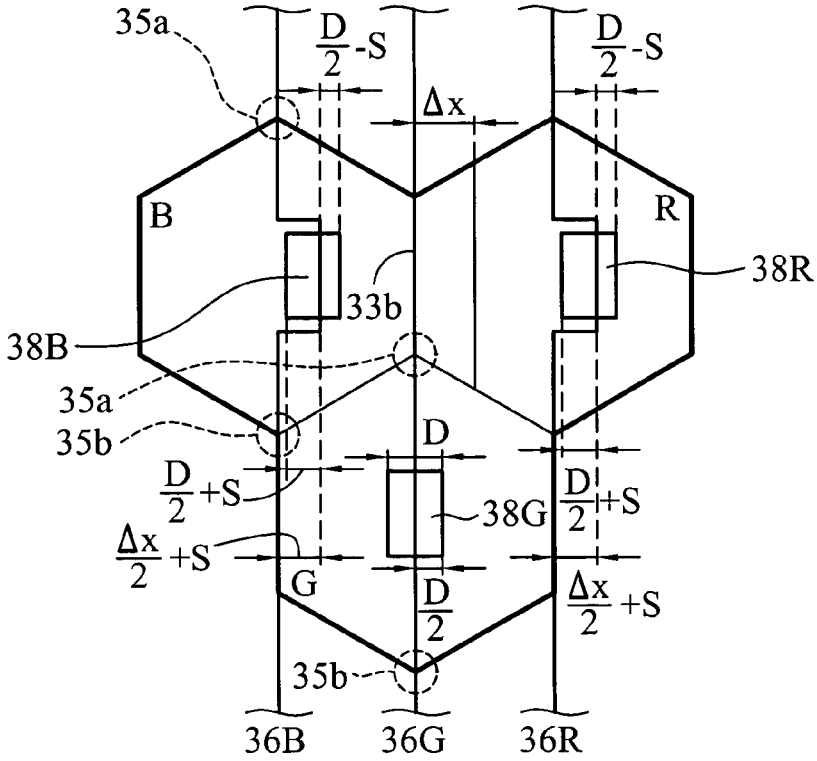

FIG. 3C shows another pattern of address electrodes for FIG. 3A according to the invention. The address electrode lines 36R, 36B and 36G still pass through a pair of opposite angles 35*a* and 35*b* of red, blue and green sub-pixels R, B and G, respectively. The address electrode lines 36G pass through the diagonal line of opposite angles 35*a* and 35*b* of strings of green sub-pixels G, identical to those in FIG. 2. The address electrode lines 36R and 36B parallely recess L=Δx/2+S in the shifting direction of the adjacent side 32 and the address electrode blocks 38R and 38B with a short side D are disposed on the recessed address electrode lines 36R and 36B in sub-pixels R and B respectively. However, rather than passing through the central axis, i.e. D/2, of the address electrode blocks 38R and 38B in FIG. 3B, the address electrode blocks 38R and 38B are disposed on the recessed address electrode lines 36R and 36B with D/2−S of the address electrode blocks 38R and 38B on the right side of the recessed address electrode lines 36R and 36B respectively and the rest D/2+S of the address electrode blocks 38R and 38B are on the left side thereof, as shown in FIG. 3C. The address electrode blocks 38G are still disposed on the center of un-recessed address electrode lines 36G, with the address electrode lines 36G passing through central axis D/2 of the address electrode blocks 38G with short side width D. The pattern of address electrodes shown in FIG. 3C is applicable when the width D of the address electrode blocks 38R and 38B exceeds than ΔX.

Figure 3D:
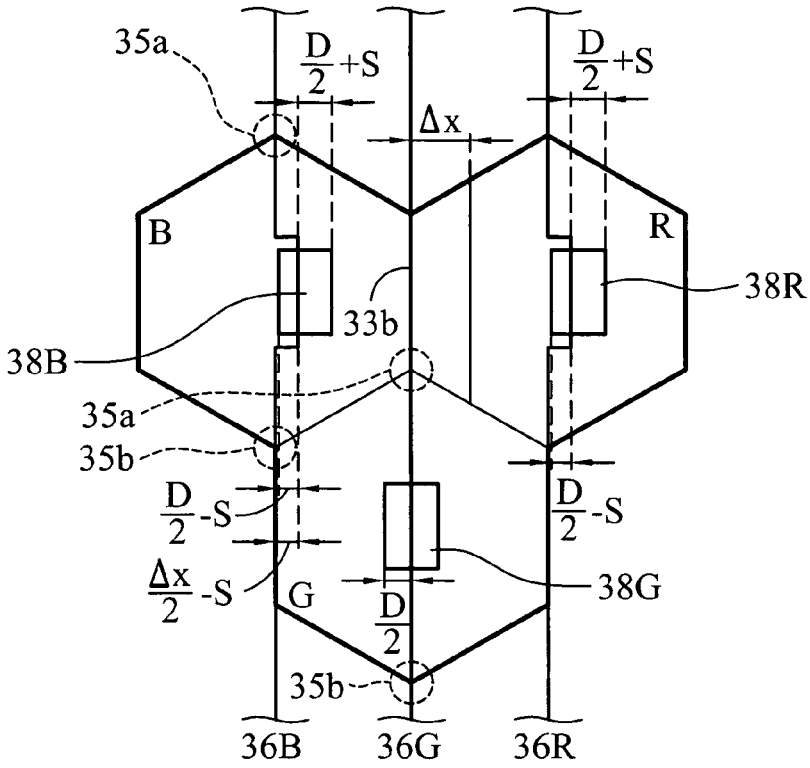

FIG. 3D shows another pattern of address electrodes for FIG. 3A according to the invention. The address electrode lines 36R, 36B and 36G still pass through a pair of opposite angles 35*a* and 35*b* of red, blue and green sub-pixels respectively. The address electrode lines 36G pass through the diagonal line of opposite angles 35*a* and 35*b* of green sub-pixels, identical to those in FIG. 2. The address electrode lines 36R and 36B parallely recess L=Δx/2−S in the shifting direction of the adjacent side 32 and the address electrode blocks 38R and 38B with a short side D are disposed on the recessed address electrode lines 36R and 36B in sub-pixels R and B respectively. However, rather than passing through the central axis, i.e. D/2, of the address electrode blocks 38R and 38B in FIG. 3B, the address electrode blocks 38R and 38B are disposed on the recessed address electrode lines 36R and 36B with D/2+S of the address electrode blocks 38R and 38B on the right side of the recessed address electrode lines 36R and 36B respectively and the rest D/2−S of the address electrode blocks 38R and 38B are on the left side thereof, as shown in FIG. 3D. The address electrode blocks 38G are still disposed on the center of the straight address electrode lines 36G, with the address electrode lines 36G passing through D/2 of the address electrode blocks 38G with short width D. The pattern of address electrodes shown in FIG. 3D is applicable when the width D of the address electrodes is less than ΔX.

Figure 3E:
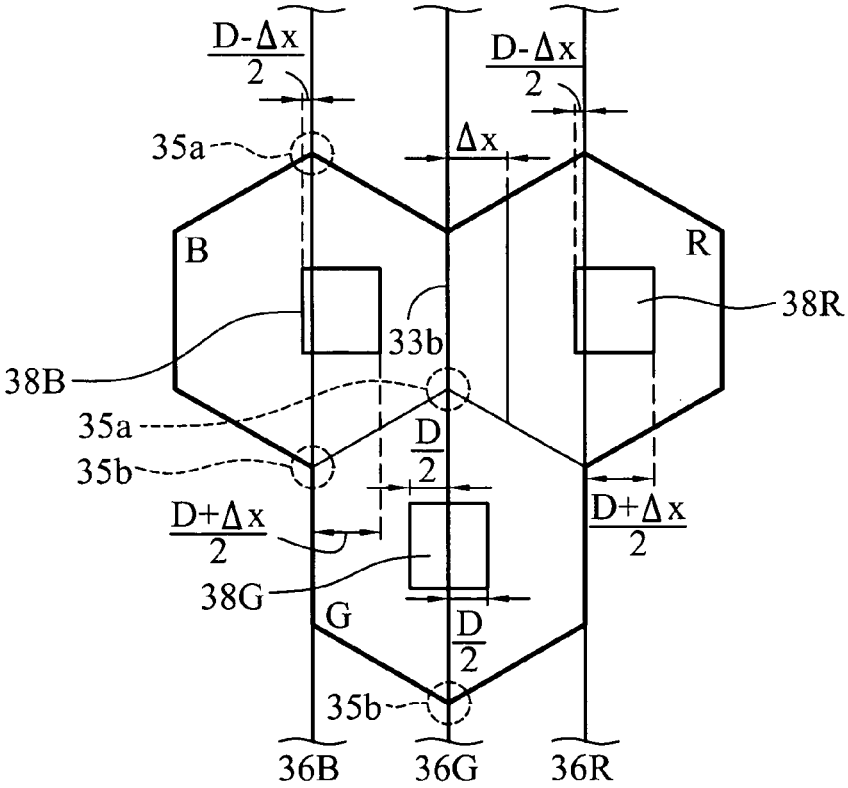

FIG. 3E shows another address electrode pattern of FIG. 3A according to the invention. The address electrode lines 36R, 36B and 36G directly pass through a pair of opposite angles 35*a* and 35*b*, parallel to a pair of opposite sides 33*a* and 33*b* of red, blue and green sub-pixels respectively. The address electrode blocks 38R and 38B are disposed on the address electrode lines 36R and 36B with (D+ΔX)/2 of the address electrode blocks 38R and 38B on the right side of the recessed address electrode lines 36R and 36B respectively and the rest (D−ΔX)/2 of the address electrode blocks 38R and 38B are on the left side thereof, as shown in FIG. 3E. The address electrode blocks 38G with short width D are still disposed on the center of the straight address electrode lines 36G in the sub-pixels G, with the address electrode lines 36G passing through D/2.

Second Embodiment

Figure 4:
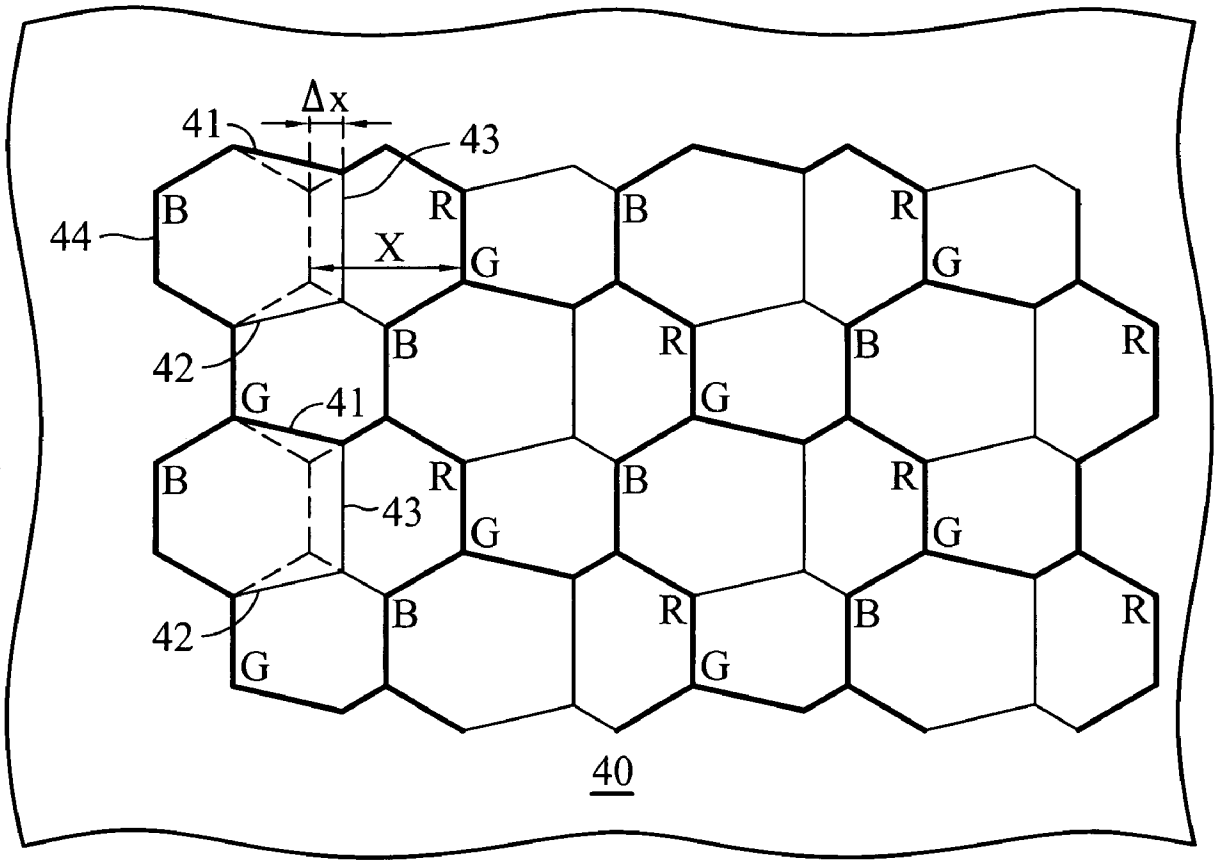
FIG. 4 is another schematic top view of a PDP rear substrate with a pattern of sub-pixels and address electrodes thereon according to the invention.

Based on FIG. 2, FIG. 4 is a schematic top view of a PDP rear substrate 40 with another pattern of sub-pixels and address electrodes thereon according to the invention. As shown in FIG. 4, the dotted lines show the original outlines of the honeycombed sub-pixels in FIG. 2 and the width between every pair of opposite parallel sides of a non-modified hexagonal sub-pixel should be X. However, the adjacent side 32 between every red and blue sub-pixel (R and B) parallely shifts toward red sub-pixel (R) for Ax and the two sides 41 and 42 adjacent to side 32 of blue sub-pixel (B) are also expanded to enclose parts of the green sub-pixels (G) adjacent below and above. Although blue sub-pixels (B) are still hexagonal, the size of the blue sub-pixels (B) in FIG. 4 is larger than in FIG. 2. Consequently, the sizes of green and red sub-pixels G and R in FIG. 4 are both decreased. As shown in FIG. 4, after the adjustment, the sizes are red sub-pixels (R)<green sub-pixels (G)<blue sub-pixels (B). However, the size of one pixel 44 (i.e. marked with bold lines) composed of a red, green and blue sub-pixel (R, G and B) in FIG. 4 still equals that in FIG. 2.

In a preferred embodiment, address electrode lines or blocks are also adjusted for better control of the sub-pixels shown in FIG. 4. Similar to ideas disclosed in the first embodiment, the address electrode blocks of the red, green and blue sub-pixels R, G and B are disposed in the center of each sub-pixel for better discharge efficiency.

Third Embodiment

Figure 5:
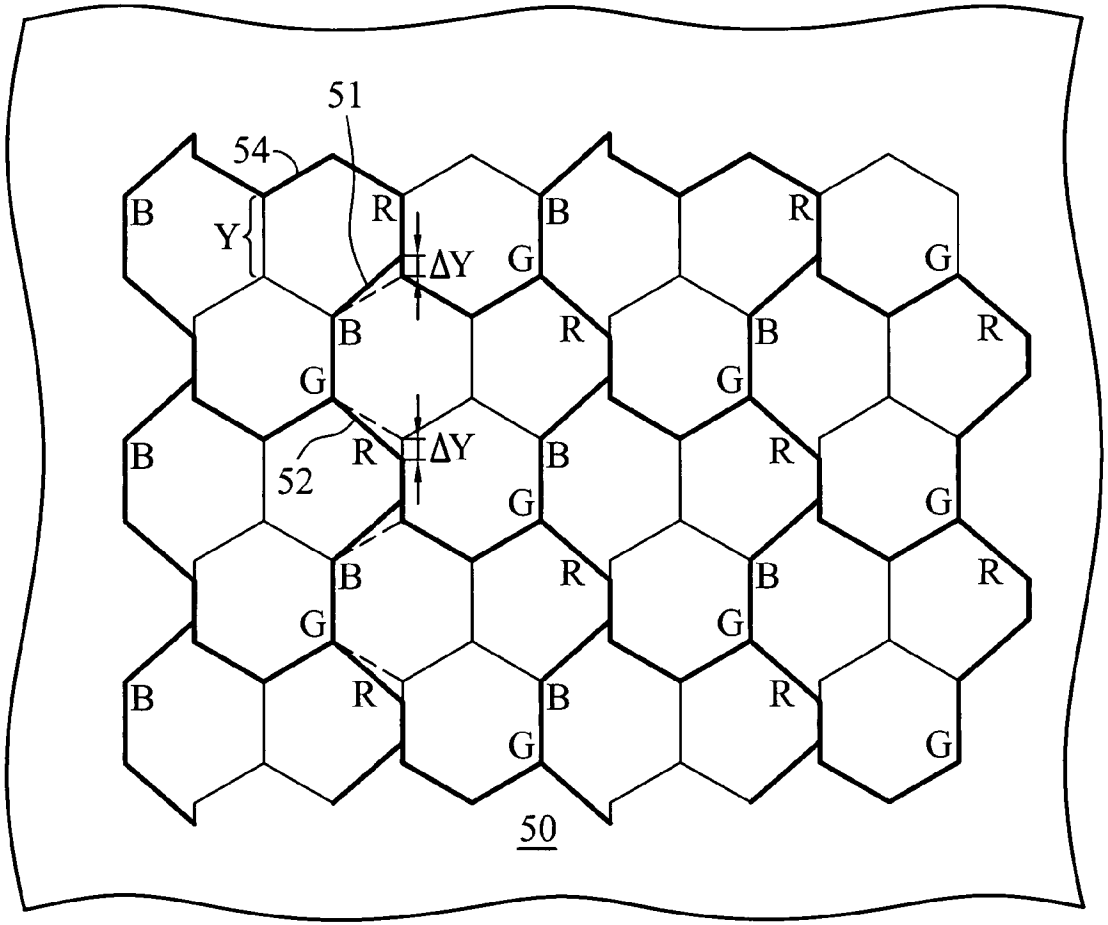
FIG. 5 is another schematic top view of a PDP rear substrate with a pattern of sub-pixels and address electrodes thereon according to the invention.

Based on FIG. 2, FIG. 5 is a schematic top view of a PDP rear substrate 50 with another pattern of sub-pixels and address electrodes thereon of the invention. As shown in FIG. 5, the dotted lines show the original outlines of honeycombed sub-pixels in FIG. 2 and the width of a side of a non-modified equilateral hexagonal sub-pixel in FIG. 2 should be Y. However, the sides 51 and 52 between one blue sub-pixel (B) and two adjacent red sub-pixels (R) both extend toward adjacent green sub-pixels (G) for ΔY and the two sides 51 and 52 of blue sub-pixels (B) are also expanded to enclose parts of the adjacent red sub-pixels (R), resulting in hat-shaped octagonal blue sub-pixels (B) as shown in FIG. 5. The sizes of the red sub-pixels (R) in FIG. 5 is decreased and the green sub-pixels (G) in FIG. 5 remain equilaterally hexagonal. As shown in FIG. 5, after the adjustment, the sizes are red sub-pixels (R)<green sub-pixels (G)<blue sub-pixels (B). However, the size of one pixel 54 (i.e. marked with bold lines) composed of a red, green and blue sub-pixel (R, G and B) in FIG. 5 still equals that in FIG. 2.

In a preferred embodiment, address electrode lines or blocks are also adjusted for better control of the sub-pixels shown in FIG. 5. Similar to ideas disclosed in the first embodiment, the address electrode blocks of the red, green and blue sub-pixels R, G and B are disposed in the center of each sub-pixel for better discharge efficiency.

Fourth Embodiment

Based on FIG. 2, FIG. 6 is a schematic top view of a PDP rear substrate 60 with another pattern of sub-pixels and address electrodes thereon according to the invention. As shown in FIG. 6, the dotted lines show the original outlines of honeycombed sub-pixels in FIG. 2 and the width of a side of a non-modified equilateral hexagonal sub-pixel in FIG. 2 is Y. However, the sides 61 and 62 between one blue sub-pixel (B) with two adjacent red sub-pixels (R) and the sides 63 and 65 between the blue sub-pixel (B) and two adjacent green sub-pixels (G) both extend outward for AY, and the two sides 61 and 62 of a blue sub-pixels (B) also expand to enclose parts of the adjacent red sub-pixels (R) and the two sides 63 and 65 of blue sub-pixels (B) also expand to enclose parts of the adjacent green sub-pixels (G). The size of the red and green sub-pixels R and G in FIG. 6 are both decreased and the red, green and blue sub-pixels R, G and B shown in FIG. 6 still remain hexagonal. As shown in FIG. 6, after the adjustment, the sizes are red sub-pixels (R)=green sub-pixels (G)<blue sub-pixels (B). The size of one pixel 64 (i.e. marked with bold lines) composed of a red, green and blue sub-pixel (R, G and B) in FIG. 6 still equals that in FIG. 2.

In a preferred embodiment, address electrode lines or blocks are also adjusted for better control of the sub-pixels shown in FIG. 6. Similar to ideas disclosed in the first embodiment, the address electrode blocks of the red, green and blue sub-pixels R, G and B are disposed in the center of each sub-pixel for better discharge efficiency.

When the rear substrate formed according to the above embodiments are assembled with a front substrate to form a plasma display panel and neon gas is filled into the sub-pixels, sustain discharge is induced between pairs of electrodes in illuminated sub-pixels, to emit ultraviolet light. The ultraviolet light excites the red, green and blue phosphors in the sub-pixels. Since the area of the blue sub-pixels is greater than that of red and green, more blue light is provided, achieving a color balance between the red and green sub-pixels affected by additional orange light from the filled neon gas.

Although honeycombed hexagons are herein used, the present invention is also applicable with sub-pixels of other patterns, such as stripe or grid-type sub-pixels, by adjusting the size of the R, G and B sub-pixels. Fundamental size restrictions comprise red sub-pixels<green sub-pixels<blue sub-pixels, to accommodate the orange light from neon gas.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A plasma display panel, comprising:

a first substrate;

a second substrate;

ribs disposed on the second substrate to space the second substrate from the first substrate, wherein the ribs have identical widths and partition off the second substrate into a plurality of first, second and third sub-pixels adjacent to each other, and both the first and second sub-pixels are smaller than the thin sub-pixels;

red phosphor disposed on each first sub-pixel;

green phosphor disposed on each second sub-pixel; and blue phosphor disposed on each third sub-pixel;

wherein adjacent first, second and third sub-pixels form a pixel and all of the pixels between the first and second substrates are filled with neon gas.

2. The plasma display panel as claimed in claim 1, wherein every first sub-pixel with red phosphor is smaller than every second sub-pixel with green phosphor.

3. The plasma display panel as claimed in claim 2, further comprising a plurality of first, second and third address electrodes disposed on the second substrate and in the center of the first, second and third sub-pixels correspondingly.

4. The plasma display panel as claimed in claim 3, wherein the first second and thin) sub-pixels are hexagonal.

5. The plasma display panel as claimed in claim 3, wherein the first and second sub-pixels with red and green phosphors respectively me hexagonal and the third sub-pixels with blue phosphor are octagonal.

6. The plasma display panel as claimed in claim 5, wherein the second sub-pixels with green phosphor are equilaterally hexagonal.

7. The plasma display panel as claimed in claim 5, wherein each pixel is dodecagonal.

8. A plasma display panel, comprising:

a first substrate;

a second substrate;

a rib structure disposed on the second substrate to space the second substrate from the first substrate, wherein the rib structure partitions off the second substrate into a plurality of first, second and third sub-pixels adjacent to each other, and both of the first and second sub-pixels are smaller than the third sub-pixels;

red phosphor disposed on each first sub-pixel;

green phosphors disposed on each second sub-pixel;

blue phosphors disposed on each third sub-pixel, wherein adjacent first, second and third sub-pixels form a pixel and all of the sub-pixels between the first and second substrates arc filled with Neon;

a plurality of first address electrodes disposed on the second substrate, wherein every first address electrode is in the center of the first sub-pixels;

a plurality of second address electrodes disposed cm the second substrate, wherein every second address electrode is in the center of the second sub-pixels; and a plurality of third address electrodes disposed on the second substrate, wherein even third address electrode is in the center of the third sub-pixels.

9. The plasma display pandas claimed in claim 8, wherein every first sub-pixel with red phosphor is smaller than or equal to every second sub-pixel with green phosphor.

10. The plasma display panel as claimed in claim 8, wherein the first, second and third sub-pixels are hexagonal.

11. T The plasma display panel as claimed in claim 8, wherein die first and second sub-pixels with red and green phosphors respectively are hexagonal and the third sub-pixels c with blue phosphor are octagonal.

12. The plasma display panel as claimed in claim 11, wherein the second sub-pixels with green phosphor are equilaterally hexagonal.

13. The plasma display panel as claimed in claim 8, wherein each pixel is dodecagonal.

* * * * *